US010233066B2

(12) United States Patent
Chang

(10) Patent No.: US 10,233,066 B2
(45) Date of Patent: Mar. 19, 2019

(54) ADJUSTABLE CAN OPENER

(71) Applicant: ALSTON TECHNOLOGIES DEVELOPMENT CO., LTD., Tainan (TW)

(72) Inventor: Kun Jen Chang, Tainan (TW)

(73) Assignee: Alston Technologies Development Co., Ltd., Tainan (TW)

( * ) Notice: Subject to any disclaimer, the term of this patent is extended or adjusted under 35 U.S.C. 154(b) by 58 days.

(21) Appl. No.: 15/340,115

(22) Filed: Nov. 1, 2016

(65) Prior Publication Data

US 2018/0118546 A1 May 3, 2018

(51) Int. Cl.
*B67B 7/00* (2006.01)
*B67B 7/46* (2006.01)

(52) U.S. Cl.
CPC ..... *B67B 7/34* (2013.01); *B67B 2007/303* (2013.01)

(58) Field of Classification Search
CPC ..... B67B 7/32; B67B 7/34; B67B 2007/303
USPC ..... 30/416–418, 421–427
See application file for complete search history.

(56) References Cited

U.S. PATENT DOCUMENTS 1,859,478 A * 5/1932 Steckmann ..... B67B 7/34 30/422
2,058,875 A * 10/1936 Higgs ..... B67B 7/32 30/420
2,255,640 A * 9/1941 Arnesen ..... B67B 7/34 30/418
3,277,570 A * 10/1966 McLean ..... B67B 7/38 30/424
3,345,742 A * 10/1967 McLean ..... B67B 7/38 30/401
3,510,941 A * 5/1970 Fyfe ..... B67B 7/34 30/417
RE27,504 E * 10/1972 Smith ..... B67B 7/34 30/418
3,719,991 A * 3/1973 French ..... B67B 7/34 30/417
3,983,625 A * 10/1976 McLean ..... B67B 7/38 30/421
4,050,155 A * 9/1977 Pitocchi ..... B67B 7/34 30/426
4,236,428 A * 12/1980 Feamster, III ..... B23B 3/24 82/128

(Continued)

FOREIGN PATENT DOCUMENTS

DE 29615737 U1 * 11/1996 ..... B67B 7/34
DE 29802030 U1 * 4/1998 ..... B67B 7/34

(Continued)

*Primary Examiner* — Jason Daniel Prone
(74) *Attorney, Agent, or Firm* — Rosenberg, Klein & Lee

(57) ABSTRACT

An adjustable can opener that includes a space adjustment assembly disposed between a main body and a washer set is provided. The space adjustment assembly includes a retaining base coupled to the main body and an adjustment shifting block fitted on the retaining base. The retaining base has a stepped portion having multiple steps. The adjustment shifting block also has a stepped portion having multiple steps. Responsive to manual rotation of the adjustment shifting block, the position where one of the steps of the adjustment shifting block is in contact with a respective one of the steps of the retaining base is changed to adjust the space between a traction wheel and a cutter wheel of the can opener.

8 Claims, 19 Drawing Sheets

(56) References Cited

U.S. PATENT DOCUMENTS 4,782,594 A * 11/1988 Porucznik ..... B67B 7/34 30/417
5,121,546 A * 6/1992 Chong ..... B67B 7/34 30/416
5,289,638 A * 3/1994 Chase ..... B67B 7/34 30/417
5,367,776 A * 11/1994 Chong ..... B67B 7/34 30/417
5,787,592 A * 8/1998 Lai ..... B67B 7/34 30/418
D404,269 S * 1/1999 Chang ..... D8/39
D404,270 S * 1/1999 Chang ..... D8/40
5,946,811 A * 9/1999 Chang ..... B67B 7/34 30/417
6,094,828 A * 8/2000 Chong ..... B67B 7/34 30/417
6,101,727 A * 8/2000 Chong ..... B67B 7/34 30/417
6,148,527 A * 11/2000 Pereira ..... B67B 7/34 30/417
D441,626 S * 5/2001 Greiner ..... D8/41
D466,771 S * 12/2002 Chang ..... D8/41
D471,412 S * 3/2003 Greiner ..... D8/41
6,618,886 B2 * 9/2003 Herren ..... B67B 7/34 30/408
6,691,419 B2 * 2/2004 Chang ..... B67B 7/32 30/416
6,829,832 B2 * 12/2004 Chang ..... B67B 7/34 30/417
D523,306 S * 6/2006 Thornton ..... D8/41
7,121,009 B2 * 10/2006 Robbins ..... B67B 7/34 30/418
7,168,170 B1 * 1/2007 So ..... B67B 7/32 30/416
D537,687 S * 3/2007 Parlowski ..... D8/41
7,353,607 B2 * 4/2008 So ..... B67B 7/32 30/416
7,409,768 B1 * 8/2008 Chapman ..... B67B 7/34 30/416
D583,207 S * 12/2008 Eide ..... D8/41
7,587,831 B2 * 9/2009 So ..... B67B 7/32 30/416
7,784,190 B2 * 8/2010 So ..... B67B 7/34 30/416
D711,710 S * 8/2014 Greiner ..... D8/40
D721,560 S * 1/2015 Roberts ..... D8/41
2006/0085991 A1 * 4/2006 Parlowski ..... B67B 7/32 30/400
2007/0033815 A1 * 2/2007 Lazaroff ..... B67B 7/32 30/416

FOREIGN PATENT DOCUMENTS

DE 202016106122 U1 * 11/2016 ..... B67B 7/32
EP 1637496 A1 * 3/2006 ..... B67B 7/32
GB 2161449 A * 1/1986 ..... B67B 7/34
GB 2420108 A * 5/2006 ..... B67B 7/34
WO WO 03053841 A1 * 7/2003 ..... B67B 7/34

* cited by examiner

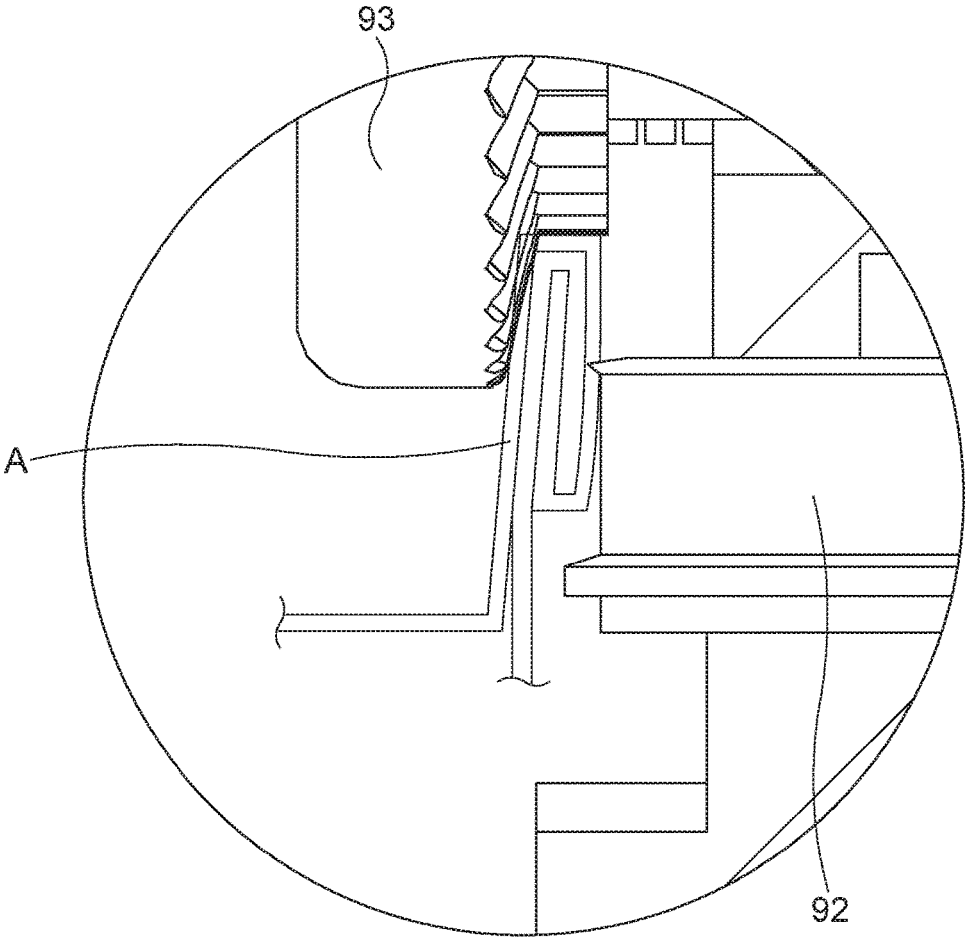
FIG. 2-A
PRIOR ART

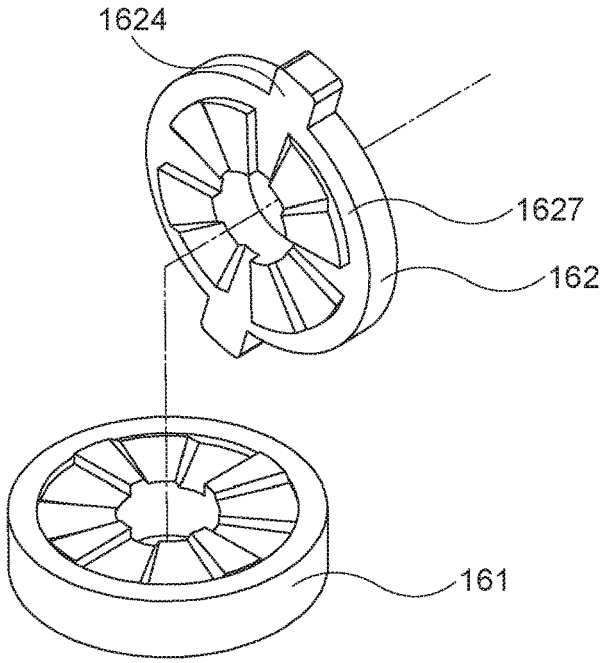
FIG. 5-A
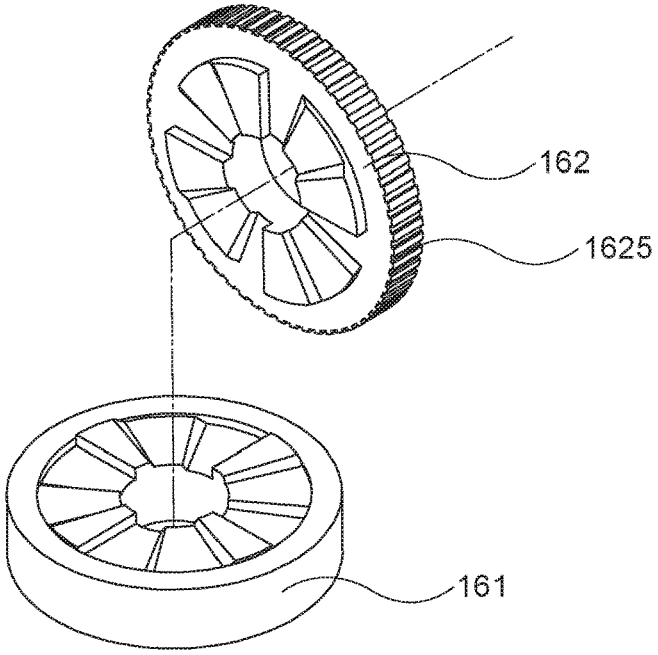
FIG. 5-B

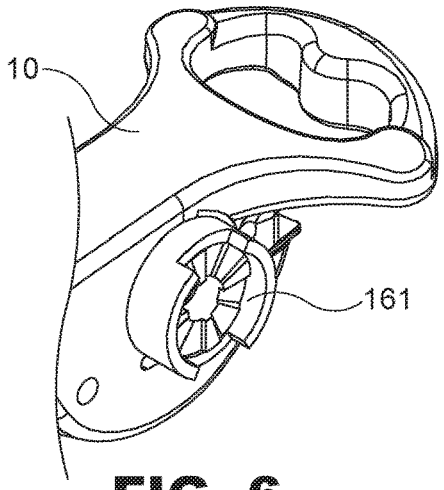
FIG. 6
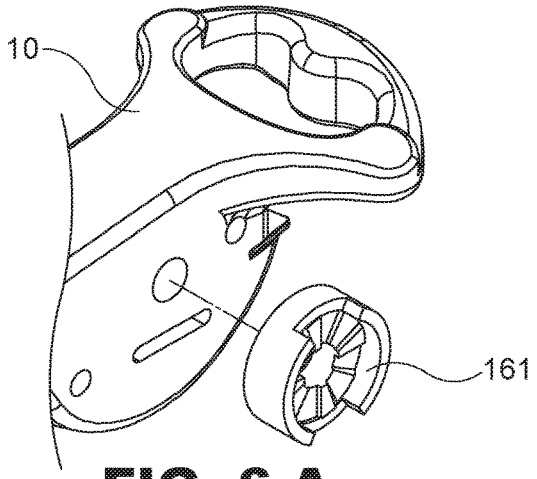
FIG. 6-A
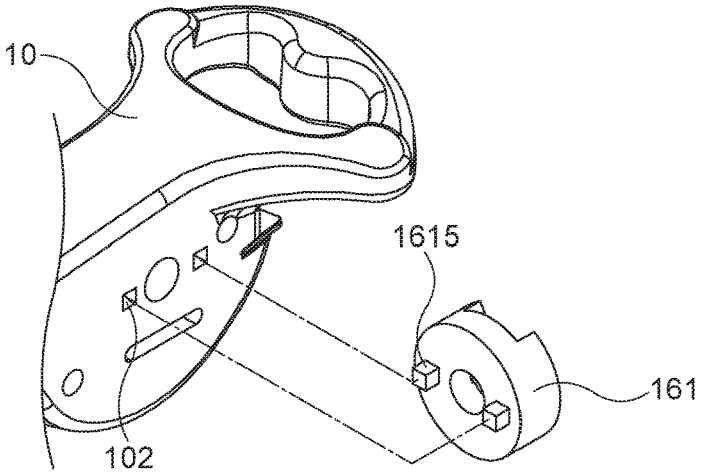
FIG. 6-B

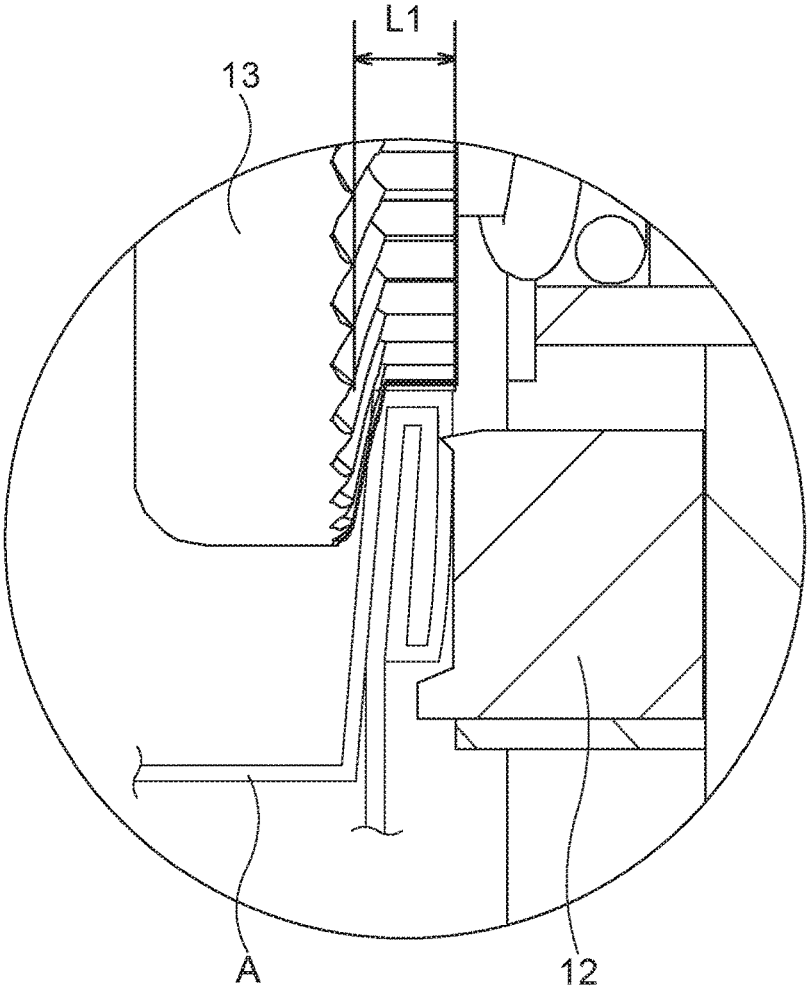
FIG. 10-A

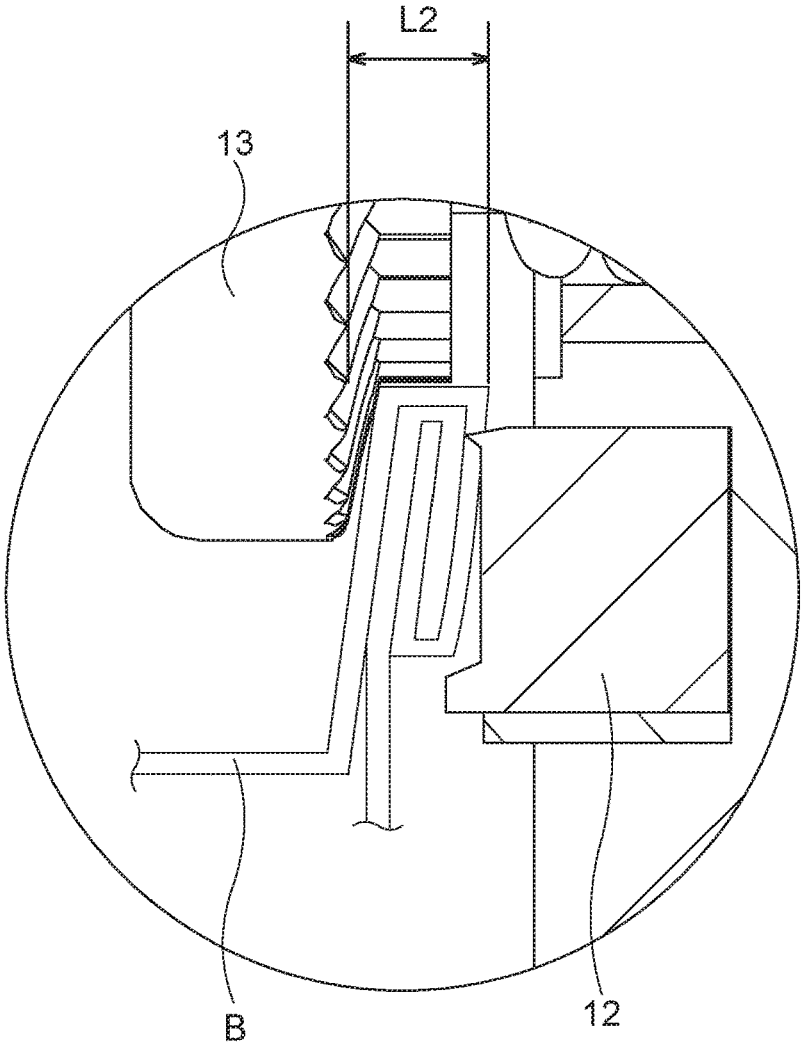
FIG. 13-A

ADJUSTABLE CAN OPENER

FIELD OF THE INVENTION

The present invention relates to a can opener, and more particularly to a lateral-cutting can opener able to adjust the space between a traction wheel and a cutter according to the thickness of the rim of a can.

BACKGROUND OF THE INVENTION

A lateral-cutting can opener is a cutting tool able to laterally cut the rim of a can. This can prevent the blade of the cutting tool from extending into the can to contaminate the food. Besides, the opening of the can won't have any sharp point, and the can lid can be reused. The lateral-cutting can opener is safe and hygienic for use and the food can be preserved with ease, so it is popular by consumers.

Accordingly, the inventor of the present invention has devoted himself based on his many years of practical experiences to develop lateral-cutting can openers, such as Taiwan Patent Publication No. 327896 and U.S. Pat. No. 5,946,811 titled "SIDE CUTTING CAN OPENER WITH A DOUBLE GRIP"; Taiwan Patent Publication No. 564884 and U.S. Pat. No. 6,829,832 titled "SINGLE-HANGLE CAN OPENER". Regarding Taiwan Patent Publication No. 327896, referring to FIG. 1, a main body 91 of a can opener 9 is provided with a cutter wheel 92 and a shaft hole 911. The shaft hole 911 is provided with a traction wheel 93. A rotary shaft 931 of the traction wheel 93 is orderly inserted through a spring 94, a sleeve 95, a washer set 96, and a hexagonal slide block 97. The distal end of the rotary shaft 931 is formed with threads 932 to mate with a positioning sleeve 98. The hexagonal slide block 97 is sleeved with a rotary lever 99. The rotary lever 99 is rotated clockwise to bring actuation of the hexagonal slide block 97 (referring to FIG. 2), enabling the positioning sleeve 98 to move from the lowest to the highest of a concave slope 971 of the hexagonal nut 97. The traction wheel 93 is moved toward the main body 91 to shorten the distance D, so that the rim of the can A is pushed toward a cutter wheel 92, enabling the cutter wheel 92 to cut into the outermost thickness of the can A so as to sever the lip of the rim of the can A.

However, the distance defined between the traction wheel 93 and the cutter wheel 92 of the conventional can opener 9 is only for the thickness of the rim of a common small can. (The total thickness of a common can is about 1-1.2 mm, namely, the thickness of a single-layer is 0.2-0.22 mm). When the can opener 9 is used to open a can B having a thicker rim (such as, a milk powder can of more than 1.5 kg, a tomato can having a diameter of more than 15 cm, or the like), referring to FIG. 3, because the rim of the can is thicker, it is laborious to rotate the rotary lever 99. Sometimes, the rotary lever 99 cannot be rotated. As a result, the can B cannot be severed smoothly. It is necessary to adjust the space between the traction wheel 93 and the cutter wheel 92. Next use, when the can opener is used to open a can A having a thinner rim (such as a condensed milk can), the cutting depth of the cutter wheel 92 is not enough for cutting the outermost thickness of the rim of the can to cause a failure in severing the can A.

In view of the shortcomings of the prior art and the previous lateral-cutting can openers invented by the applicant, the can opener is subjected to the size of the can and the thickness of the rim of the can. Accordingly, the inventor of the present invention has devoted himself based on his many years of practical experiences to solve this problem.

SUMMARY OF THE INVENTION

The primary object of the present invention is to provide an adjustable can opener provided with a space adjustment assembly. Through the space adjustment assembly, the space between a traction wheel and a cutter wheel is adjustable, so that the can opener can be applied to various cans to enhance its practicability.

In order to achieve the aforesaid object, the adjustable can opener of the present invention comprises a main body. One end of the main body is coupled with a support rod and a cutter wheel. The main body has a through shaft hole. The shaft hole is provided with a traction wheel having a rotary shaft. The rotary shaft is inserted through an elastic member, a sleeve, a washer set, and a clamping slide block unit. A distal end of the traction wheel is provided with a rotary lever. By turning the rotary lever, the traction wheel tightly clamps a rim of a can to bring the can to turn for the cutter wheel to cut a lip of the rim of the can. A space adjustment assembly is provided between the main body and the washer set. The space adjustment assembly comprises a retaining base and an adjustment shifting block. The retaining base is coupled to the main body. The retaining base has a stepped portion consisting of at least two steps. The adjustment shifting block is mated with the retaining base. The adjustment shifting block also has a stepped portion consisting of at least two steps. Through rotation of the adjustment shifting block, a position where one of the steps of the adjustment shifting block is mated with a corresponding one of the steps of the retaining base is changed to change a space between the traction wheel and the cutter wheel.

When the can opener is used to open a can having a thinner rim, the adjustment shifting block of the space adjustment assembly is rotated, enabling the first step of the adjustment shifting block to mate with the second step of the retaining base to increase the space between the adjustment shifting block and the retaining base. The traction wheel is moved toward the rotary lever, such that the space between the traction wheel and the cutter wheel is reduced. The rim of the can is placed in between the traction wheel and the cutter wheel. The rotary lever is rotated, enabling the cutter wheel to cut the lip of the can rim. When the can opener is used to open a can having a thicker rim. The adjustment shifting block of the space adjustment assembly is rotated, enabling the first step of the adjustment shifting block to mate with the third step of the retaining base to decrease the space between the adjustment shifting block and the retaining base, such that the space between the traction wheel and the cutter wheel is increased. The rim of the can is placed in between the traction wheel and the cutter wheel. The rotary lever is rotated, enabling the cutter wheel to cut the lip of the can rim. Through the space adjustment assembly of the can opener, the user can rotate the adjustment shifting block to adjust the space between the traction wheel and the cutter wheel according to the can to be severed, so that the can opener can be applied to various cans to enhance its practicability.

BRIEF DESCRIPTION OF THE DRAWINGS

FIG. 2A is a partial enlarged view of FIG. 2;

FIG. 5A and FIG. 5B are schematic views of different embodiments of the retaining base and the adjustment shifting block of the present invention;

FIG. 6, FIG. 6A and FIG. 6B are schematic views showing the connection between the retaining base and the main body of the present invention;

FIG. 10A is a partial enlarged view of FIG. 10;

FIG. 13A is a partial enlarged view of FIG. 13;

DESCRIPTION OF THE PREFERRED EMBODIMENTS

Embodiments of the present invention will now be described, by way of example only, with reference to the accompanying drawings.

Figure 1:
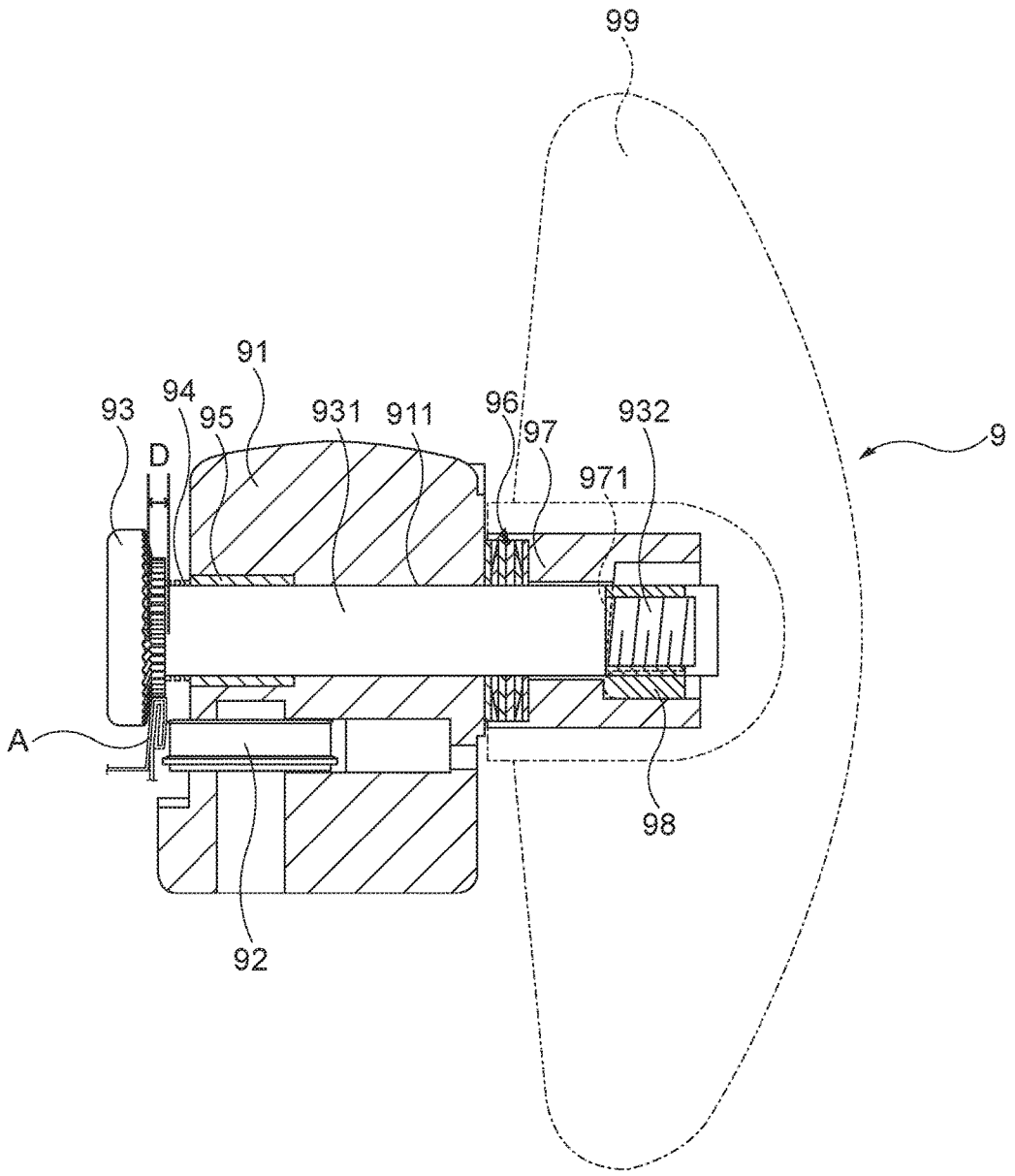
FIG. 1 PRIOR ART
FIG. 1 is a sectional view of a conventional can opener.
Figure 2:
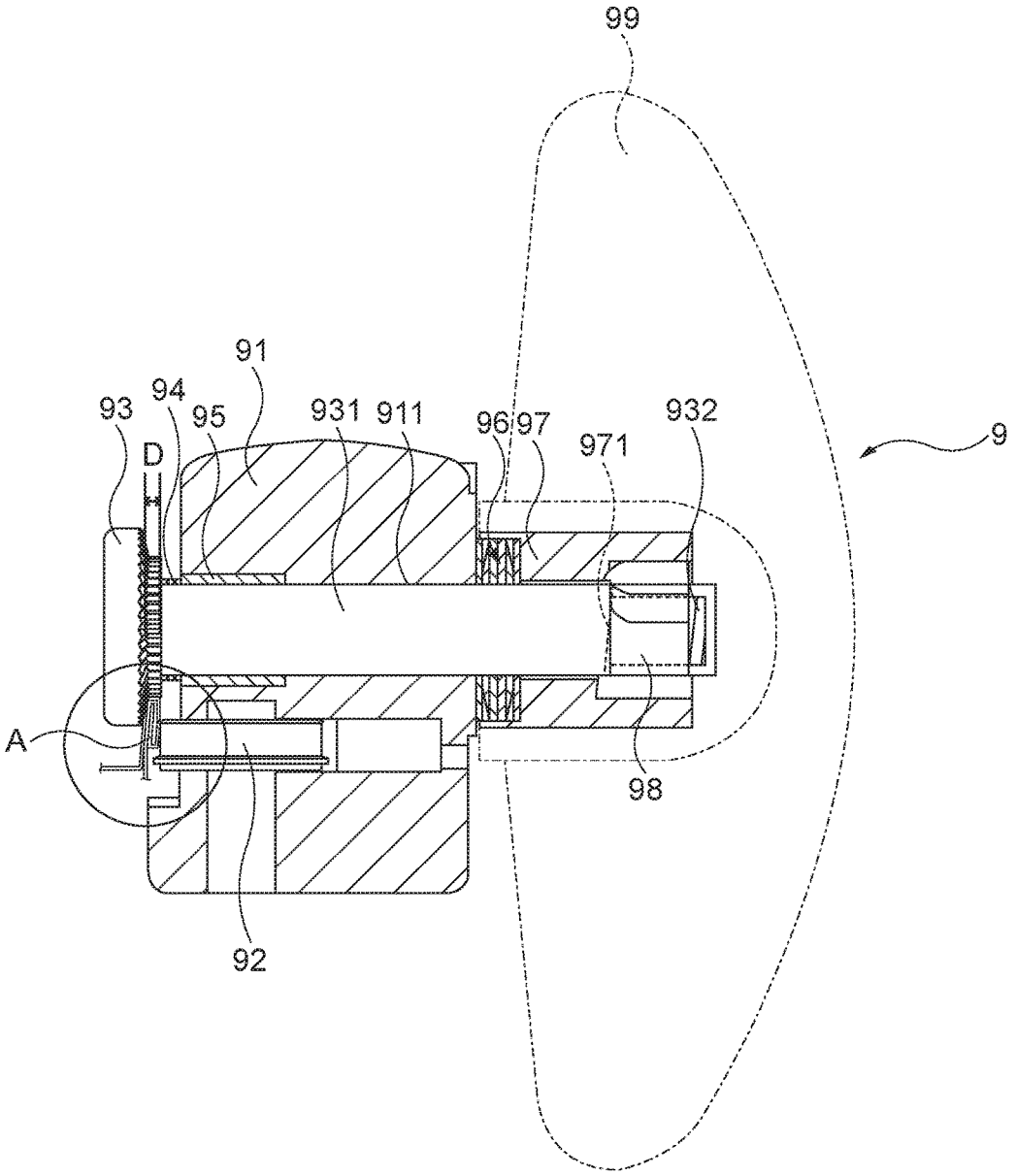
FIG. 2 PRIOR ART
FIG. 2 is a schematic view of the conventional can opener to sever a can A having a thinner rim.
Figure 3:
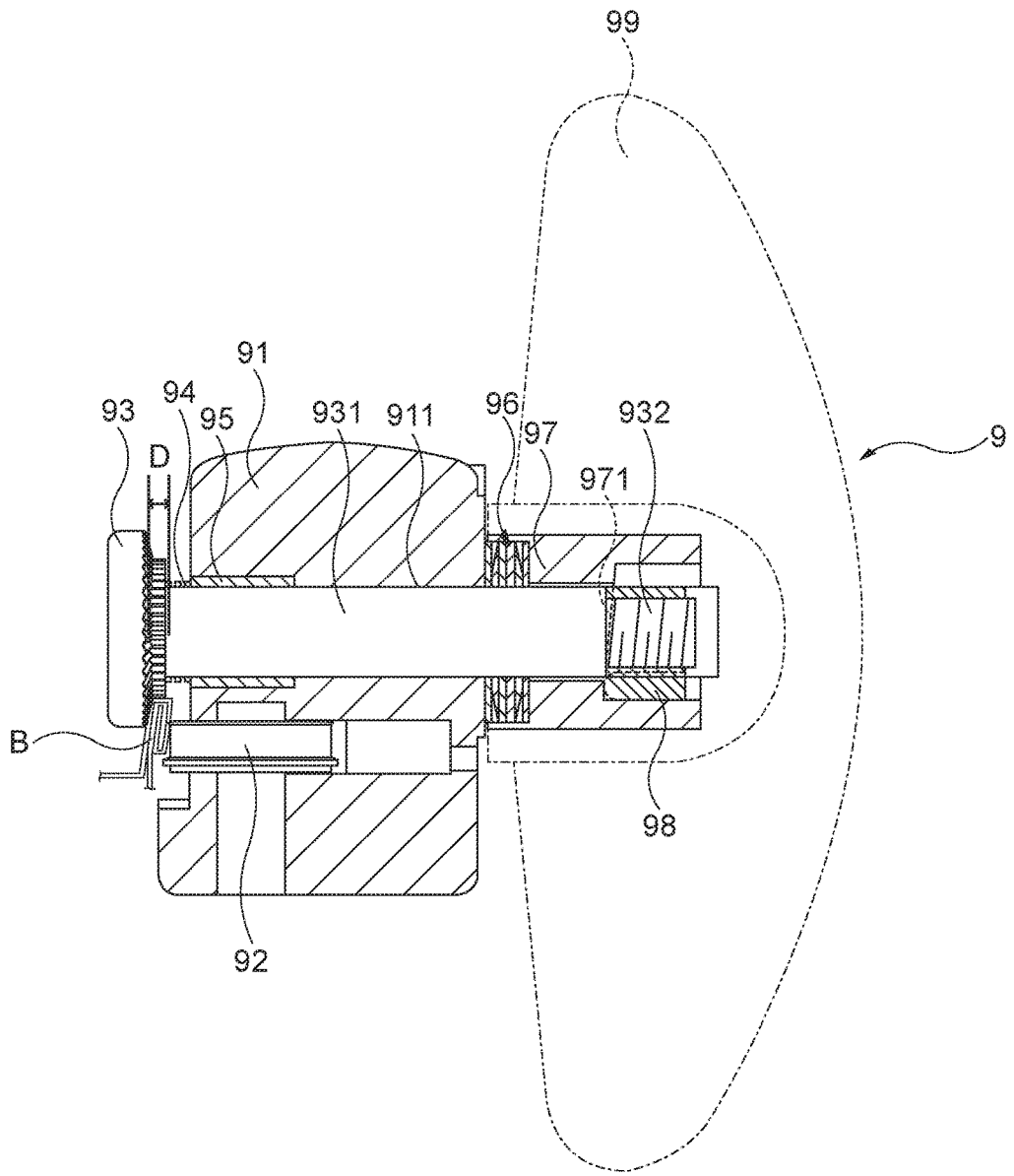
FIG. 3 PRIOR ART
FIG. 3 is a schematic view of the conventional can opener to sever a can B having a thicker rim.
Figure 4:
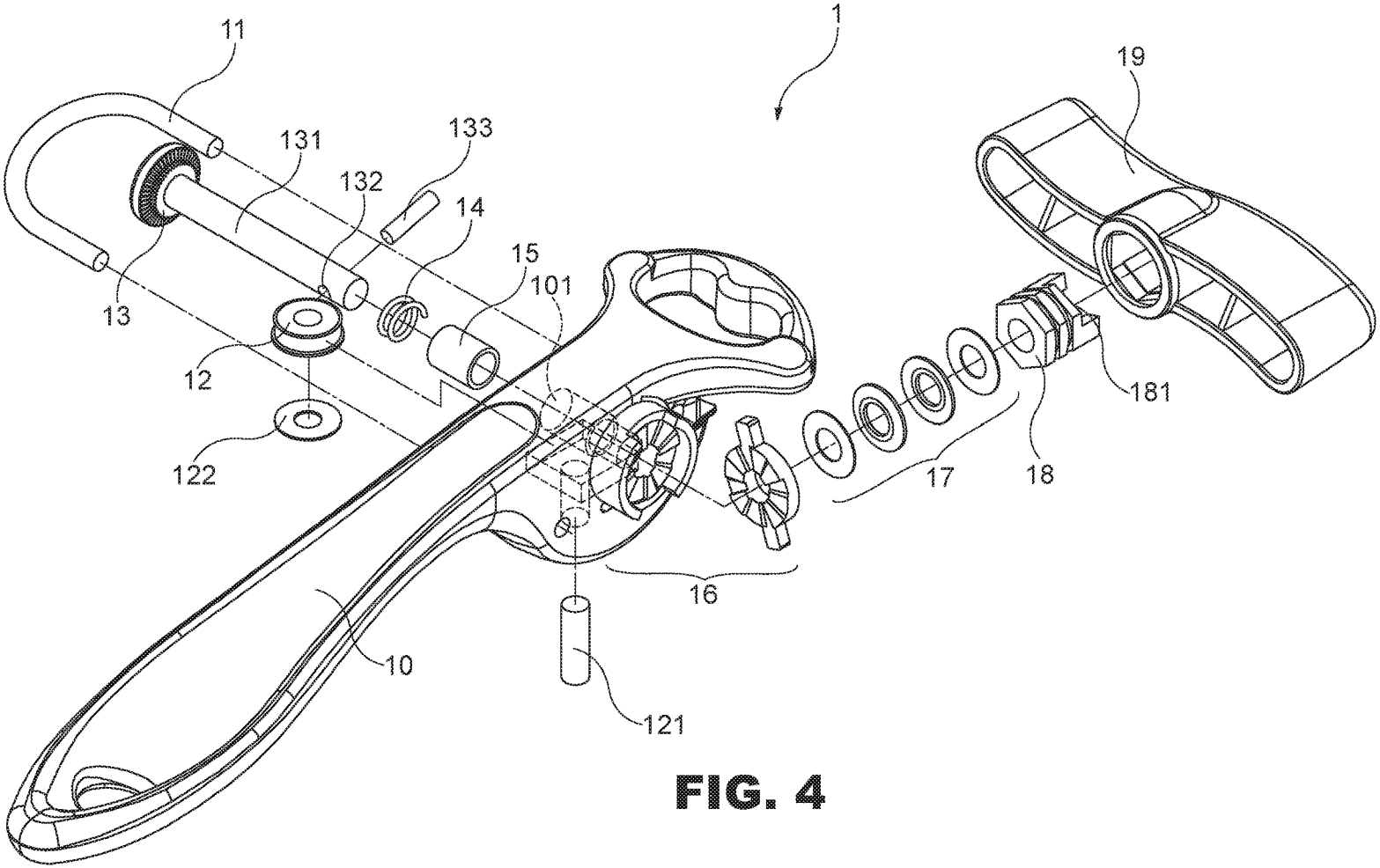
FIG. 4 is an exploded view of the present invention applied to a single-grip can opener.
Figure 5:
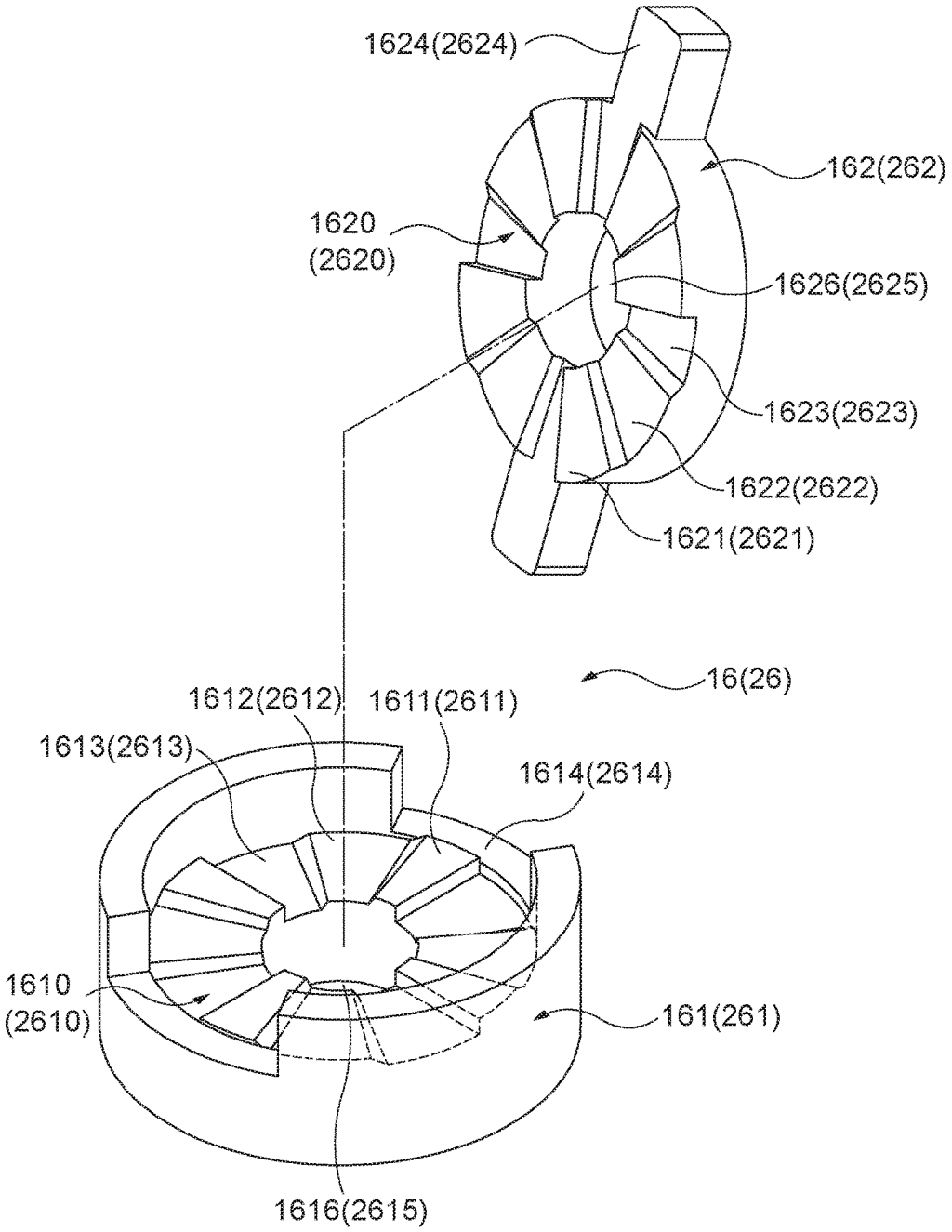
FIG. 5 is an exploded view of the present invention.

First, referring to FIG. 4, a single-grip can opener 1 in accordance with an embodiment of the present invention comprises a main body 10. One end of the main body 10 is coupled with a support rod 11 and a cutter wheel 12. The cutter wheel 12 is secured to main body 10 through a shaft 121. A washer 122 is provided beneath the cutter wheel 12. The main body 10 has a through shaft hole 101. The shaft hole 101 is provided with a traction wheel 13 having a rotary shaft 131. The rotary shaft 131 has a through hole 132. The rotary shaft 131 of the traction wheel 13 is orderly inserted through an elastic member 14, a sleeve 15, the shaft hole 101 of the main body 10, a space adjustment assembly 16, a washer set 17, and a clamping slide block unit 18. The clamping slide block unit 18 has a slope 181. A pin 133 is inserted through the through hole 132 of the rotary shaft 131 to be in contact with the slope 181 of the clamping slide block unit 18, such that the traction wheel 13 is pressed against the clamping slide block unit 18. A rotary lever 19 is engaged with the clamping slide block unit 18. In an embodiment of the present invention, the main body 10 of the single-grip can opener 1 may be coupled with a grab handle. The space adjustment assembly 16 comprises a retaining base 161 and an adjustment shifting block 162 (referring to FIG. 5). The retaining base 16 is coupled to the main body 10 and has a central through hole 1616. The retaining base 1 has a stepped portion 1610 consisting of at least two steps. In an embodiment of the present invention, the stepped portion 1610 includes a first step 1611, a second step 1612, and a third step 1613. The adjustment shifting block 162 is mated with the retaining base 161 and has a central through hole 1626. The adjustment shifting block 162 also has a stepped portion 1620 consisting of at least two steps. In an embodiment of the present invention, the stepped portion 1620 includes a first step 1621, a second step 1622, and a third step 1623. Through rotation of the adjustment shifting block 162, the position where the first step 1621 of the adjustment shifting block 162 is mated with one of the steps of the retaining base 161 may be changed. In an embodiment of the present invention, the retaining base 161 has a notch 1614, and the adjustment shifting block 162 has a protruding block 1624. The protruding block 1624 of the adjustment shifting block 162 is located in the notch 1614 of the retaining base 161 to limit rotation.

Regarding the configuration of the retaining base 161 and the adjustment shifting block 162, in an embodiment of the present invention, the retaining base 161 doesn't have the notch 1614 (as shown in FIG. 5A). An outer edge of the adjustment shifting block 162 is formed with an engaging wall 1627, enabling the adjustment shifting block 162 to slide on the retaining base 161 via the engaging wall 1627. In another embodiment of the present invention, the adjustment shifting block 162 doesn't have a protruding block 1624. An outer edge of the adjustment shifting block 162 is formed with teeth 1625 (as shown in FIG. 5B) and the diameter of the adjustment shifting block 162 is greater than that of the retaining base 161, enabling the adjustment shifting block 162 to shift on the retaining base 161.

Regarding the connection between the retaining base 161 and the main body 10, in an embodiment of the present invention, the retaining base 161 is integrally formed with the main body 10 by injection molding (as shown in FIG. 6). In another embodiment of the present invention, the retaining base 161 is fixed to the main body 10 by binding (as shown in FIG. 6A). In a further embodiment of the present invention, the main body 10 is provided with at least one aperture 102, and the retaining base 161 is provided with at least one stud 1615. The stud 1615 of the retaining base 161 is engaged in the aperture 102 of the main body 10, as shown in FIG. 6B.

Figure 7:
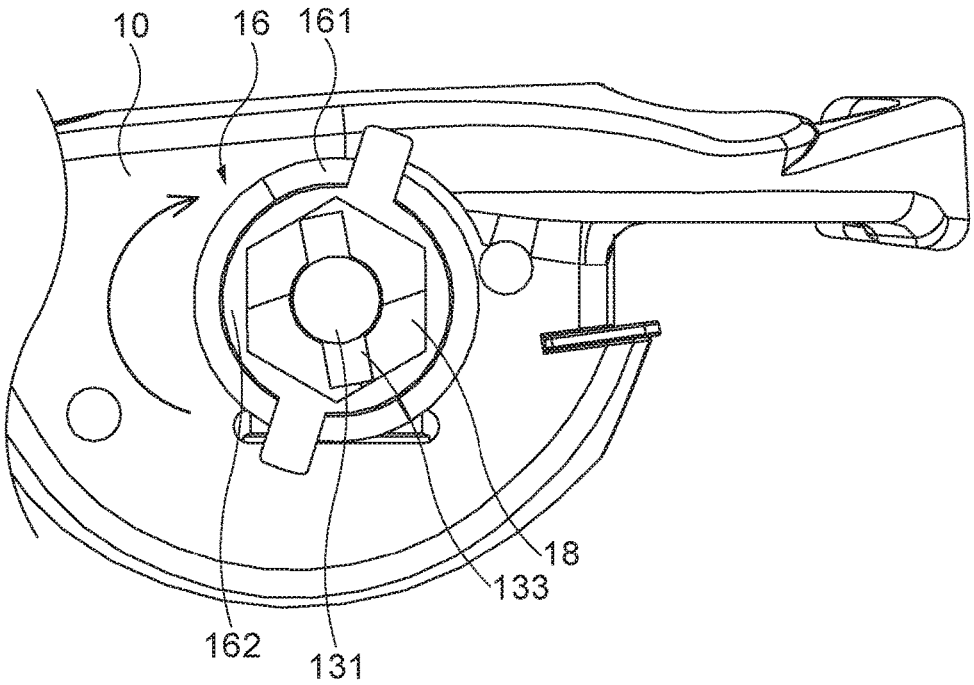
FIG. 7, FIG. 8 and FIG. 9 are schematic views of the present invention applied to a single-grip can opener to sever a can A having a thinner rim.
Figure 8:
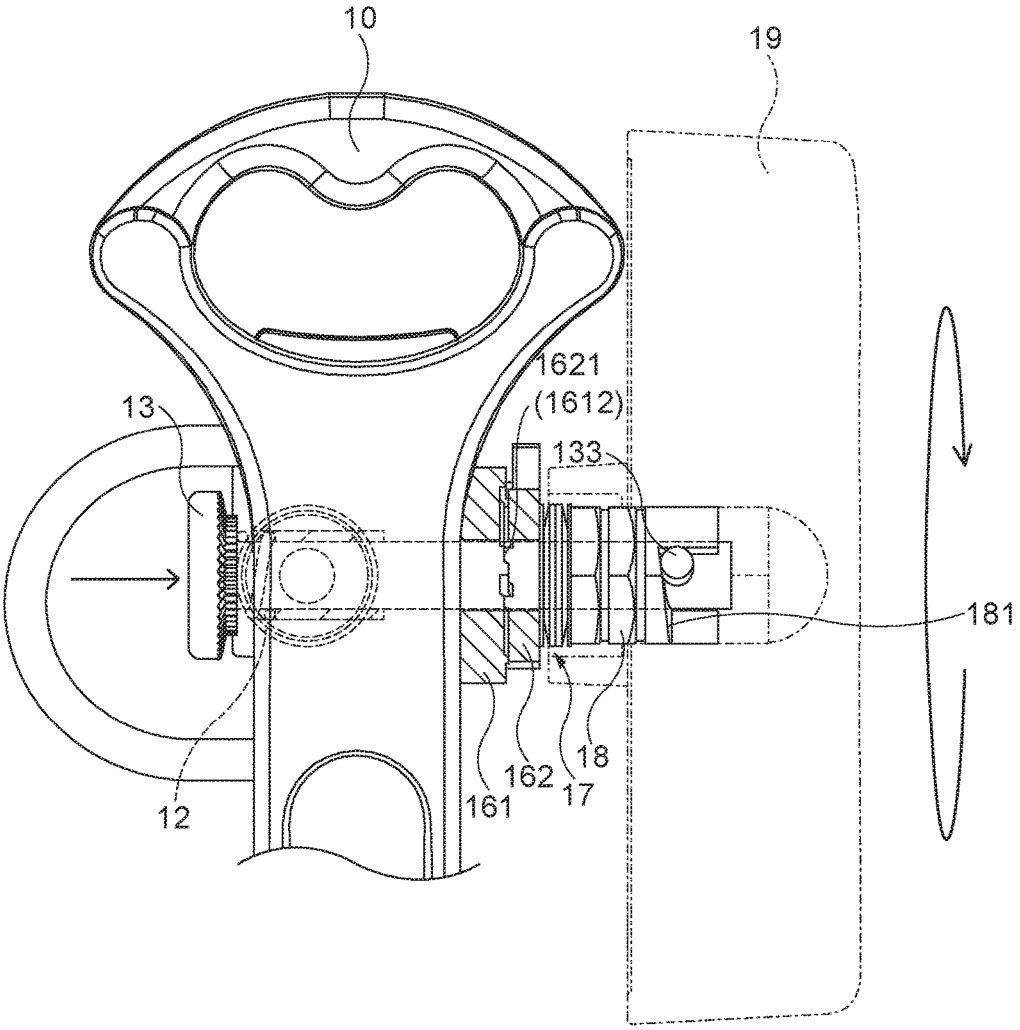
Figure 9:
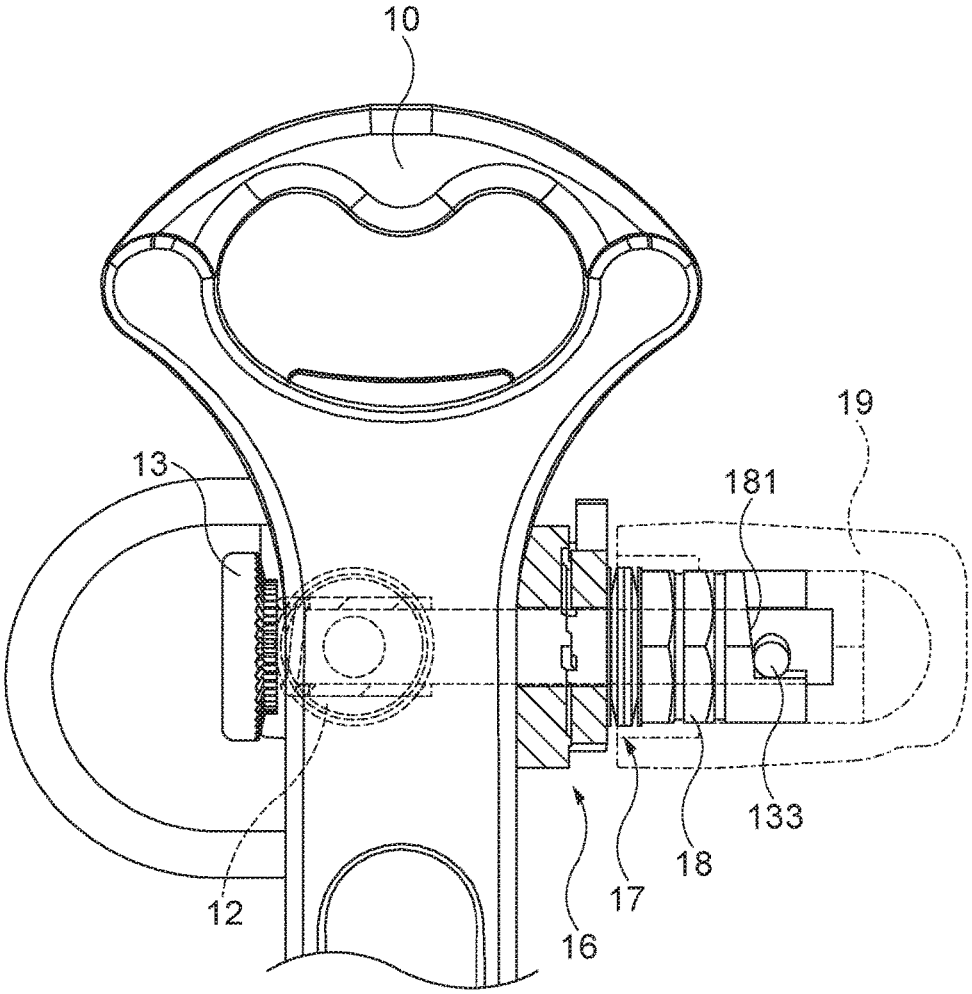
Figure 10:
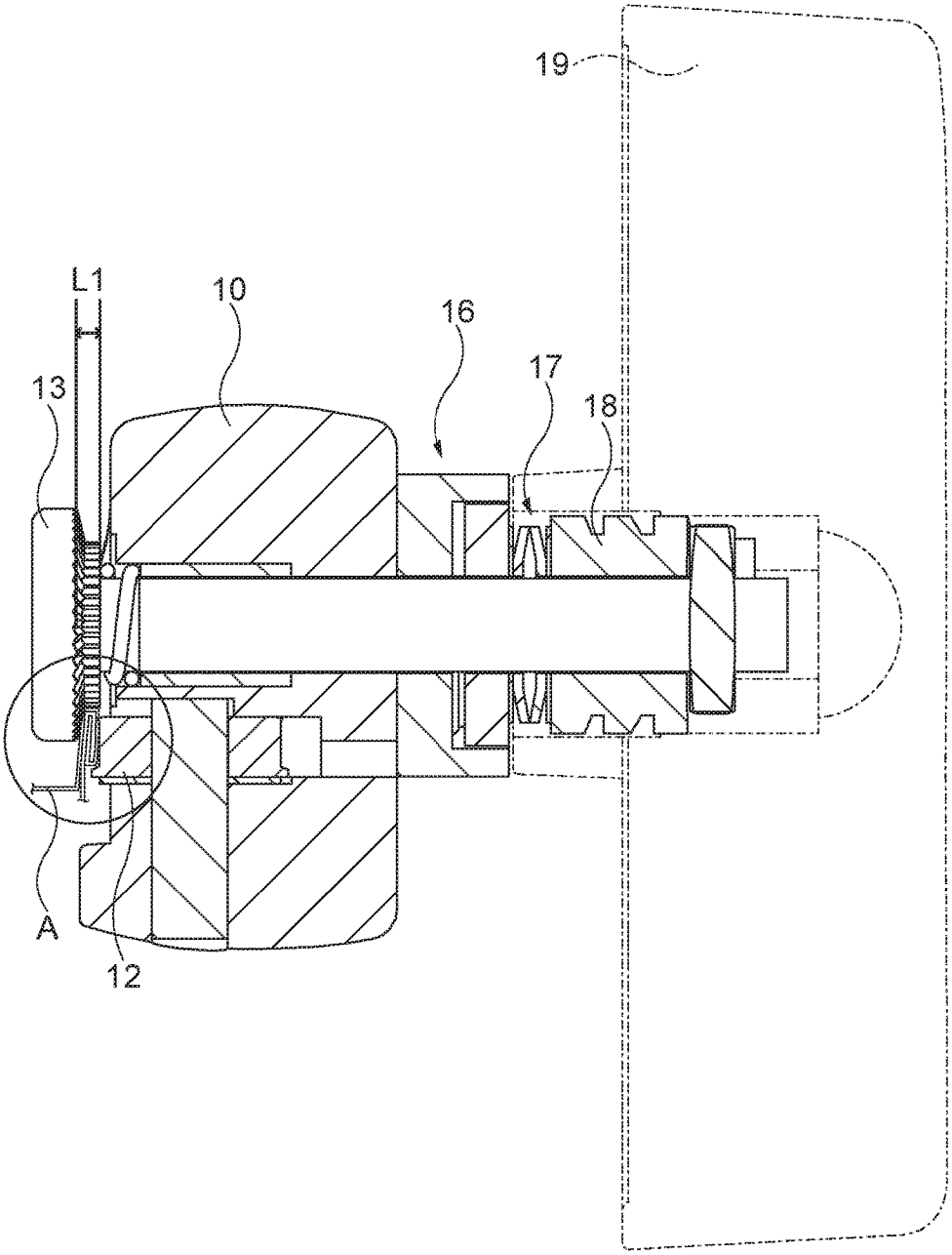
FIG. 10 is a sectional view of the present invention applied to a single-grip can opener to sever a can A having a thinner rim.

When the can opener 1 is used to open a can A having a thinner rim, referring to FIG. 7, the adjustment shifting block 162 is rotated (as the arrow direction of FIG. 7), enabling the first step 1621 of the adjustment shifting block 162 to mate with the second step 1612 of the retaining base 161 (referring to FIG. 8) to increase the space between the adjustment shifting block 162 and the retaining base 161. The traction wheel 13 is moved toward the rotary lever 19 (as shown in FIG. 8), such that the space between the traction wheel 13 and the cutter wheel 12 is reduced (as shown in FIG. 10). In this manner, the can A having a thinner rim (such as a condensed milk can) can be placed in between the traction wheel 13 and the cutter wheel 12. After that, the rotary lever 19 is rotated clockwise, such that the pin 133 at the distal end of the traction wheel 13 is moved to the highest of the slope 181 of the clamping slide block unit 18 (as shown in FIG. 9), enabling the cutter wheel 12 to cut the lip of the can rim (as shown in FIG. 10 and FIG. 10A). When the user continues to turn the rotary lever 19 clockwise, the can A is brought to turn by the clamping and traction action of the traction wheel 13 and the cutter wheel 12, so that the of the lip of the can rim be severed continuously.

Figure 11:
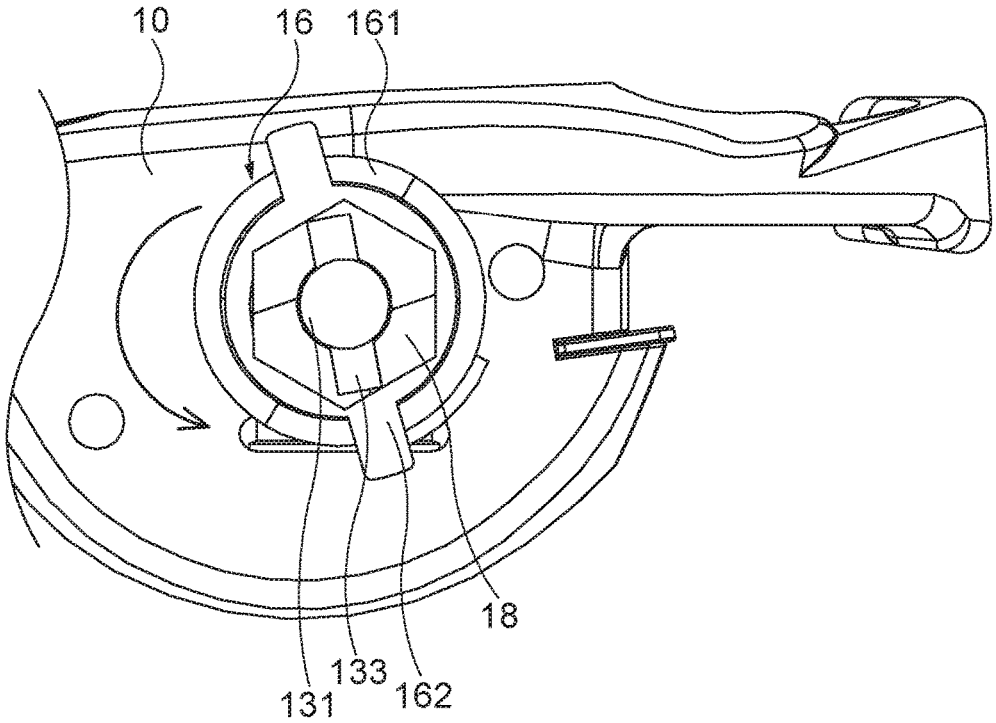
FIG. 11 and FIG. 12 are schematic views of the present invention applied to a single-grip can opener to sever a can B having a thicker rim.
Figure 12:
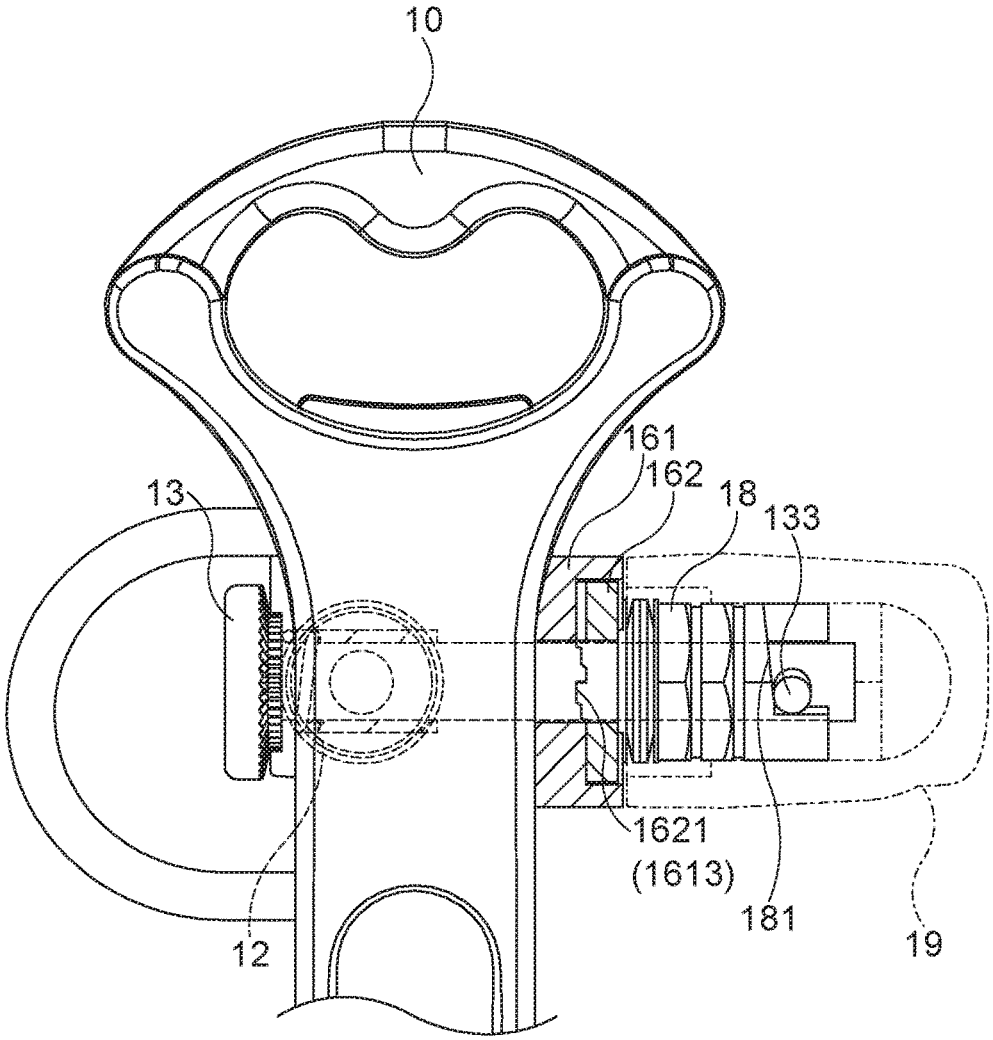
Figure 13:
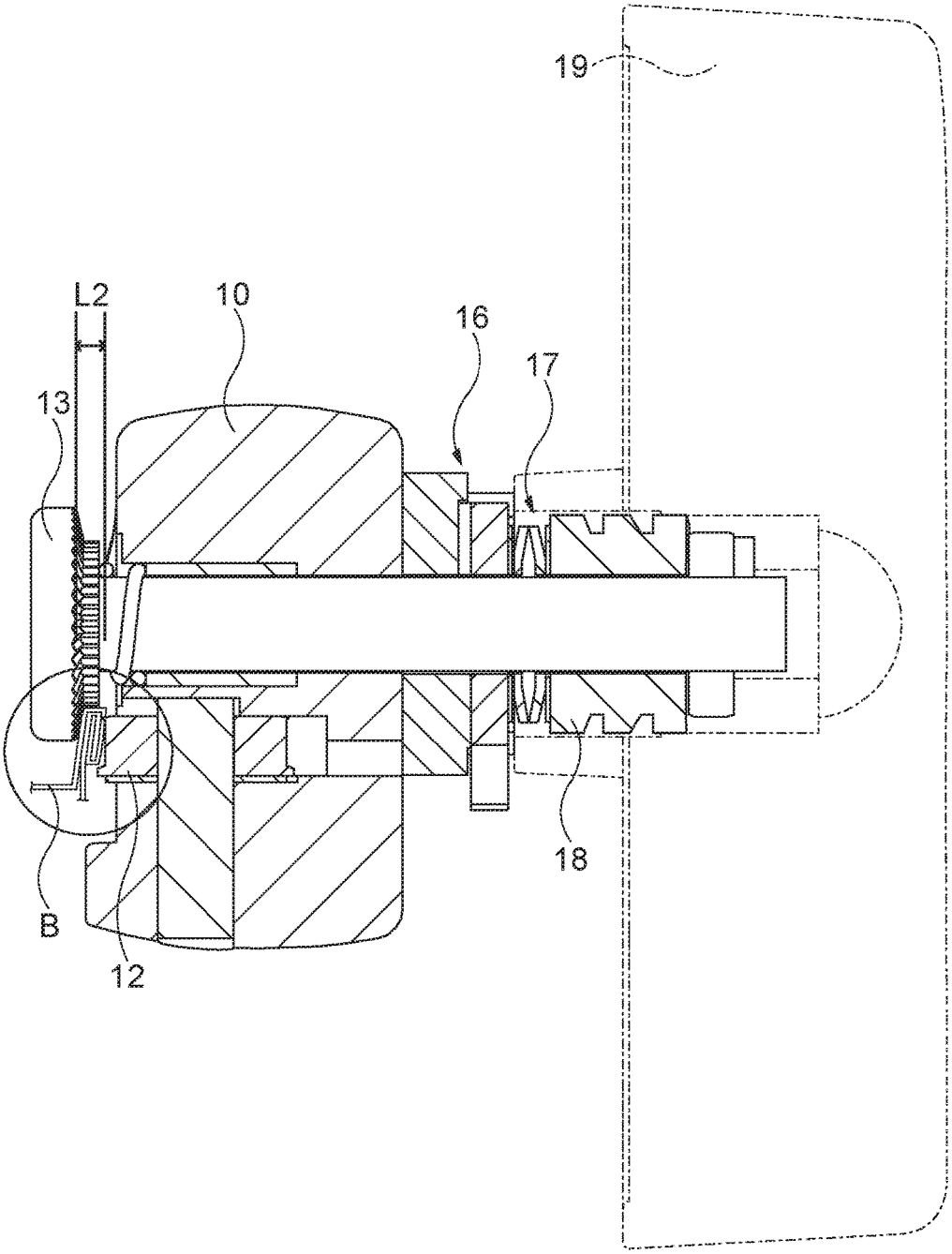
FIG. 13 is a sectional view of the present invention applied to a single-grip can opener to sever a can B having a thicker rim.

When the can opener 1 is used to open a can B having a thicker rim, referring to FIG. 11, the adjustment shifting block 162 is rotated (as the arrow direction of FIG. 11), enabling the first step 1621 of the adjustment shifting block 162 to mate with the third step 1613 of the retaining base 161 (referring to FIG. 12) to decrease the space between the adjustment shifting block 162 and the retaining base 161, such that the space L2 between the traction wheel 13 and the cutter wheel 12 is increased (as shown in FIG. 13). Thus, an appropriate space is formed for the can B having a thicker rim (such as, a milk powder can of more than 1.5 kg, a tomato can having a diameter of more than 15 cm, or the like) to be placed in between the traction wheel 13 and the cutter wheel 12. After that, the rotary lever 19 is rotated clockwise, such that the pin 133 of the traction wheel 13 is moved to the highest of the slope 181 of the clamping slide block unit 18 (referring to FIG. 12) to reduce the space between the traction wheel 13 and the main body 10, enabling the cutter wheel 12 to cut the lip of the can rim (as shown in FIG. 13A). When the user continues to turn the rotary lever 19 clockwise, the can B is brought to turn by the clamping and traction action of the traction wheel 13 and the cutter wheel 12, so that the lip of the can rim can be severed continuously.

Figure 14:
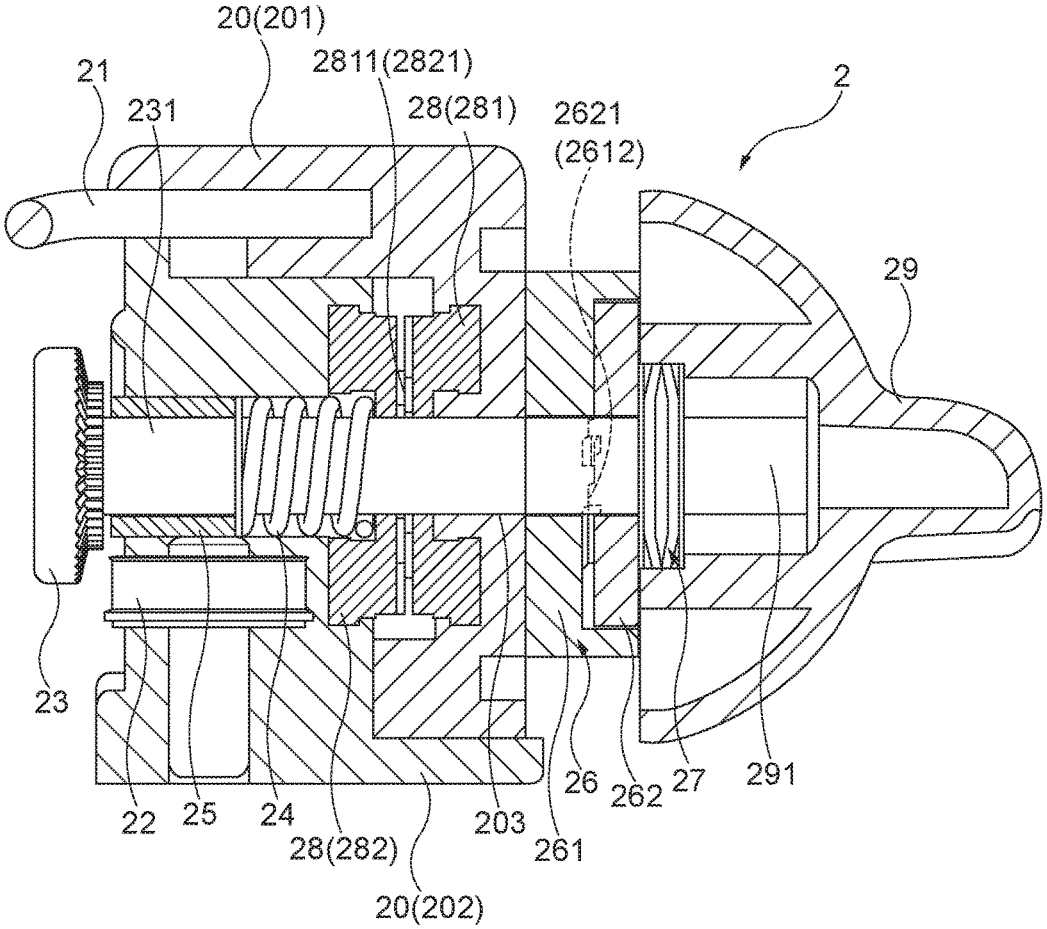
FIG. 14 and FIG. 15 are schematic views of the present invention applied to a double-grip can opener
Figure 15:
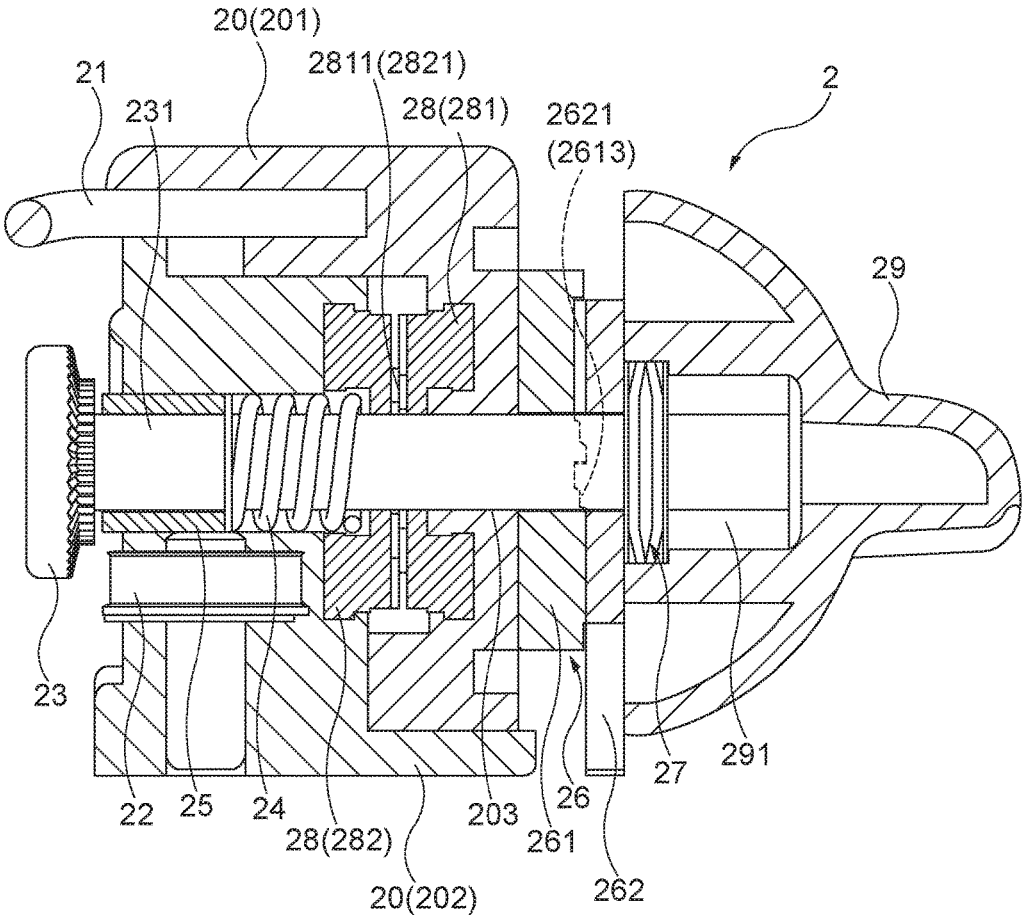

Referring to FIG. 14, in this embodiment, the present invention is applied to a double-grip can opener 2 as disclosed in U.S. Pat. No. 5,946,811. The double-grip can opener 2 comprises a main body 20 combined with a grab handle. The main body 20 includes an upper main body 201 and a lower main body 202. A retaining base 261 of a space adjustment assembly 26 is coupled to the upper main body 201. A clamping slide block unit 28 comprises a first ratchet 281 and a second ratchet 282. The first ratchet 281 is coupled to the upper main body 201. The second ratchet 282 is coupled to the lower main body 202. The first ratchet 281 and the second ratchet 282 are provided with a ratchet block 2811, (2821), respectively. A rotary shaft 231 of a traction wheel 23 is orderly inserted through a sleeve 25, an elastic member 24, the clamping slide block unit 28, a shaft hole 203 of the main body 20, the space adjustment assembly 26, a washer set 27 and a hexagonal nut 291, and then coupled to a rotary lever 29. Through rotation of the adjustment shifting block 262 of the space adjustment assembly 26, the position where a first step 2621 of a stepped portion 2620 is mated with a stepped portion 2610 of the retaining base 261 may be changed to change the space between the adjustment shifting block 262 and the retaining base 261 and further to adjust the space between the traction wheel 23 and the main body 20. As shown in FIG. 14, the first step 2621 of the adjustment shifting block 262 is mated with a second step 2612 of the retaining base 261 to increase the space between the adjustment shifting block 262 and the retaining base 261. The traction wheel 23 is moved toward the rotary lever 29, such that the space between the traction wheel 23 and a cutter wheel 22 is reduced. In this manner, the can A having a thinner rim can be placed in between the traction wheel 23 and the cutter wheel 22. The upper main body 201 is pressed down, such that the ratchet block 2811 of the first ratchet 281 is coupled to the ratchet block 2821 of the second ratchet 282 to reduce the space between the traction wheel 23 and the main body 20, enabling the cutter wheel 22 to cut the lip of the can rim. When the user continues to turn the rotary lever 29 clockwise, the can A (not shown in FIG. 14) is brought to turn for performing the cutting action continuously. On the contrary, the adjustment shifting block 262 of the space adjustment assembly 26 is rotated, enabling the first step 2621 of the adjustment shifting block 262 to mate with a third step 2613 of the retaining base 261 (referring to FIG. 15) to decrease the space between the adjustment shifting block 262 and the retaining base 261, such that the space between the traction wheel 23 and the cutter wheel 22 is increased for a can B having a thicker rim (not shown in FIG. 15) to be severed easily.

Thereby, the can opener 1 (2) is provided with the space adjustment assembly 16 (26). The user can rotate the adjustment shifting block 162 (262) of the space adjustment assembly 16 (26) to adjust the space between the traction wheel 13 (23) and the cutter wheel 12 (22) according to the can to be severed. The can opener 1 (2) can be widely used for any kind of can, enhancing its practicability.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. An adjustable can opener, comprising:

a main body, one end of the main body being coupled with a support rod and a cutter wheel, the main body having a through shaft hole;

a traction wheel coupled to a rotary shaft, the rotary shaft being inserted through an elastic member and a sleeve and that combination being received in the through shaft hole, a portion of the rotary shaft passing through the shaft hole having a washer set and a clamping slide block unit slidably sleeved thereon, the clamping slide block unit having a sloped surface on a rear side thereof, and a distal end of the rotary shaft being provided with a pin extending through a through hole formed in the rotary shaft and being disposed in contact with the sloped surface of the clamping slide block unit;

a space adjustment assembly sleeved on the rotary shaft between the main body and the washer set, the space adjustment assembly including a retaining base and an adjustment shifting block, each of the retaining base and the adjustment shifting block having a respective central through hole through which the rotary shaft passes, the retaining base being coupled to the main body and having a first stepped portion including a first step, a second step, and a third step, the second and third steps being of a progressively lesser height than the first step, the adjustment shifting block having a user graspable surface for selectively rotating the adjustment shifting block on the rotary shaft relative to the retaining base, the adjustment shifting block including a second stepped portion including a first step, a second step, and a third step in contact with the first stepped portion of the retaining base, the second and third steps of the second stepped portion being of a progressively lesser height than the first step of the second stepped portion, wherein, manual rotation of the adjustment shifting block from a position where the first step of the adjustment shifting block is in contact with the first step of the retaining base to a position where the first step of the adjustment shifting block is in contact with one of the second or third steps of the retaining base changes a space between the adjustment shifting block and the main body and thereby displaces the clamping slide block unit under a bias force of the elastic member to in turn adjust a space between the traction wheel and the cutter wheel; and a rotary lever being engaged with the clamping slide block unit, wherein rotation of the rotary lever correspondingly initially rotates the clamping slide block unit relative to the pin to reduce a space between the traction wheel and the main body by positioning a highest part of the sloped surface of the clamping slide block unit in contact with the pin, the traction wheel thereby tightly clamping a rim of a can disposed between the traction wheel and the main body, further rotation of the rotatory lever rotates the clamping slide block unit and the pin therewith to rotate the rotary shaft, the traction wheel and the can in correspondence therewith for the cutter wheel to cut a lip of the rim of the can.

2. The adjustable can opener as claimed in claim 1, wherein the retaining base is integrally formed with the main body.

3. The adjustable can opener as claimed in claim 1, wherein the retaining base is fixed to the main body by binding.

4. The adjustable can opener as claimed in claim 1, wherein the main body is provided with at least one aperture, the retaining base is provided with at least one stud, and the stud of the retaining base is engaged in the aperture of the main body.

5. The adjustable can opener as claimed in claim 1, wherein an outer edge of the retaining base has at least one notch.

6. The adjustable can opener as claimed in claim 1, wherein the user graspable surface is an at one least protruding block extending from an outer portion of the adjustment shifting block.

7. The adjustable can opener as claimed in claim 1, wherein an outer edge of the adjustment shifting block is formed with an engaging wall.

8. The adjustable can opener as claimed in claim 1, wherein the user graspable surface is an outer edge of the adjustment shifting block formed with a plurality of teeth thereon, a diameter of the adjustment shifting block being greater than that of the retaining base.

* * * * *